United States Patent [19]

Steinberger

[11] Patent Number: 4,632,005

[45] Date of Patent: Dec. 30, 1986

[54] TREMOLO MECHANISM FOR AN ELECTRIC GUITAR

[75] Inventor: Ned Steinberger, Cornwall, N.Y.

[73] Assignee: Steinberger Sound Corporation, Newburgh, N.Y.

[21] Appl. No.: 656,501

[22] Filed: Oct. 1, 1984

[51] Int. Cl.[4] ..... G10D 3/04

[52] U.S. Cl. ..... 84/313; 84/297 S; 84/298; 84/304; 84/312 R

[58] Field of Search ..... 84/297 R, 304, 312 R, 84/313, 297 S, 298, 299, 307

[56] References Cited

U.S. PATENT DOCUMENTS

| | | | |
|---|---|---|---|
| 383,275 | 5/1888 | Bowers | 84/298 |
| 2,972,923 | 2/1961 | Fender | 84/313 |
| 3,326,072 | 6/1967 | Price | 84/313 |
| 3,411,394 | 11/1968 | Jones | 84/313 |
| 4,079,652 | 3/1978 | Gittler | 84/1.16 |
| 4,141,271 | 2/1979 | Mullen | 84/312 P |
| 4,170,161 | 10/1979 | Kaftan | 84/312 R |
| 4,457,201 | 7/1984 | Storey | 84/313 |
| 4,475,432 | 10/1984 | Stroh | 84/314 N |

*Primary Examiner*—Lawrence R. Franklin

*Attorney, Agent, or Firm*—Finnegan, Henderson, Farabow, Garrett & Dunner

[57] ABSTRACT

A tremolo mechanism for adjusting the spring tension of a stringed musical instrument, the instrument including a body, a neck portion, a plurality of strings each anchored at one end to the neck portion and extending over at least a portion of the neck portion and the body, the mechanism comprising a base for attachment to the body; a pivot plate mounted on the base for detuning the strings substantially evenly and for maintaining the strings in substantially the same pitch relative to each other when the pivot plate is pivoted with respect to the base, including a plurality of sliders for anchoring the other end of each of the strings; and a bridge positioned between the pivot plate and the neck. A method for rapid tuning of a stringed musical instrument, a string for a stringed musical instrument, and an improved stringed instrument are also disclosed.

36 Claims, 16 Drawing Figures

FIG. 12.
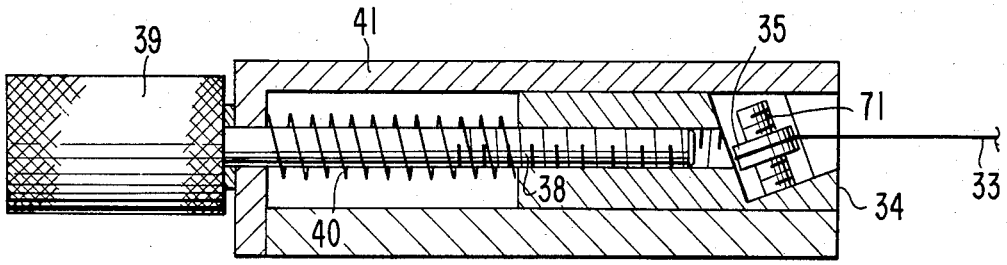
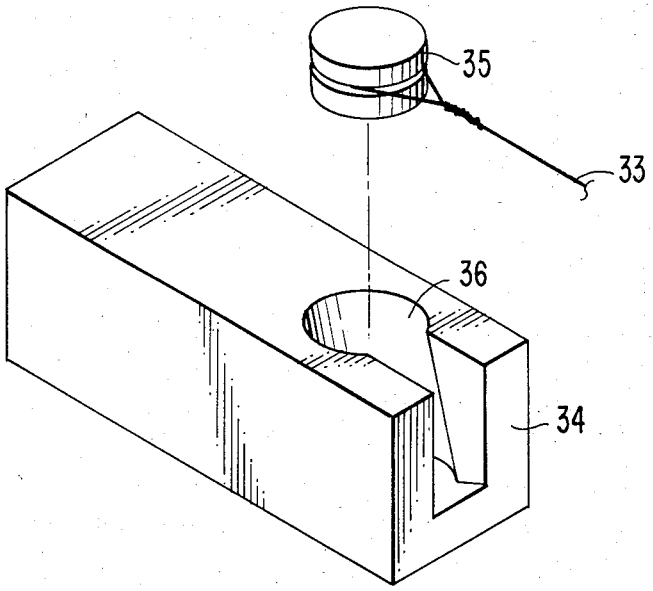
FIG. 13.
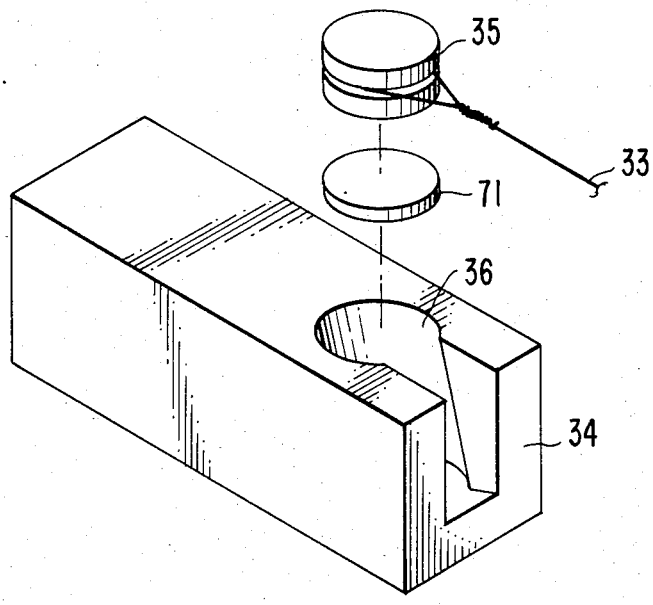
FIG. 14.

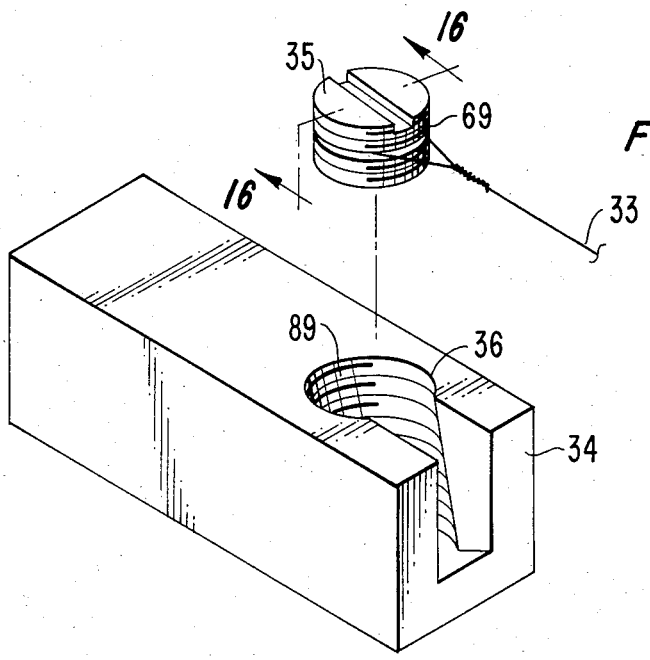
FIG. 15.
FIG. 16.
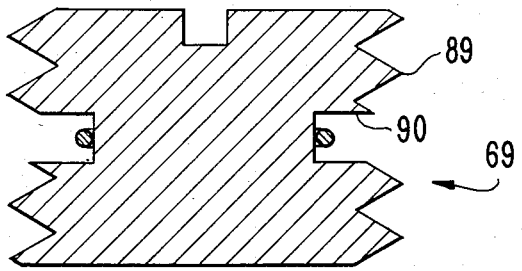

TREMOLO MECHANISM FOR AN ELECTRIC GUITAR

FIELD OF THE INVENTION

This invention relates to stringed musical instruments, and more specifically to a mechanism for producing tremolo in a stringed musical instrument. The invention also relates to a method of tuning a stringed instrument having a tremolo device thereon, and strings used for stringed musical instruments.

BACKGROUND OF THE INVENTION

Tremolo devices have been used for many years with stringed musical instruments for creating a vibrato sound. Various structures have been proposed and utilized in the prior art for this purpose.

Broadly, a tremolo mechanism provides a means for changing the tension on all of the strings of the instrument simultaneously to create a pitch change during vibration of the strings. Typically, a moving tailpiece on the body of the guitar is utilized to accomplish this tension change. In such a mechanism, a pivot point is established, and the tailpiece pivots about that point. A counter spring is generally utilized to counteract the pull of the strings on the tailpiece. A handle is generally provided for facilitating the pivoting of the tailpiece, while simultaneously playing the instrument.

One of the most troublesome problems with prior art tremolo mechanisms has been the difficulty of initially tuning the instrument. In general, tuning any one string creates a slight change in the tuning of the other strings. Thus, each string must be individually tuned and retuned multiple times in order to reach a satisfactory pitch relationship. Similarly, when a musician attempts to finger bend individual strings, the tune of the open notes is changed slightly, because any change in the tension of a single string moves the equilibrium point of the tremolo mechanism.

Another significant problem relates to the pitch relationship between the individual strings. In the prior art devices, all strings of the instrument are typically moved the same distance when the mechanism is actuated. Since the higher pitched strings of the instrument generally have much more stretch than the lower strings, the lower strings change pitch more readily. For example, if a chord is played on the instrument, and the tremolo mechanism is actuated, the low strings of the instrument detune faster than the high strings, and the pitch relationships within the chord are lost.

Accordingly, it is a primary object of this invention to quickly change the string pitch in a stringed musical instrument while maintaining the same relative pitch relationship between the strings.

It is a further object of the invention to rapidly and simply tune the strings of a stringed musical instrument having a tremolo mechanism thereon.

Another object of the invention is to lock a tremolo mechanism in place during the tuning of a stringed musical instrument, and to simply and efficiently unlock the mechanism and adjust it to a desired tuned position.

Additional objects and advantages of the invention will be set forth in part in the description which follows, and in part will be obvious from the description or will be learned by practice of the invention.

SUMMARY OF THE INVENTION

In accordance with the purposes of the invention, as embodied and broadly described herein, the tremolo mechanism of this invention is for adjusting the string tension of a stringed musical instrument, the instrument including a body, a neck portion, a plurality of strings each anchored at one end to the neck portion and extending over at least a portion of the neck portion. The mechanism includes a base or support for attachment to the body, means pivotally mounted on the base for detuning the strings substantially evenly and for maintaining the strings in substantially the same pitch relative to each other. The detuning means includes means for anchoring the other end of each string, and the mechanism also includes bridge means positioned between the detuning means and the neck.

Preferably, the detuning means includes locking means for securing the detuning means against pivotal movement on the base. It is also preferred that the locking means include a lock member fixed to the base and a corresponding key member pivotally attached to the detuning means, the lock member and the key member for securing the detuning means against pivotal movement on the base.

The detuning means preferably includes a pivot plate mounted on the base for pivotal movement about a pivot point, the plate including a plurality of channels. One of the channels corresponds to and is aligned with each of the strings, and the means for anchoring the other end of each of the strings includes a plurality of tuning sliders one of the sliders being slidably mounted in each channel. It is preferred that each string include a ball on one end thereof, and each slider include an opening for receiving one of the balls.

The detuning means may also include a plurality of threaded rods, one of the rods being threaded into each of the sliders for adjusting the position of the slider in the channel when the rod is manually threaded into or out of the slider. A tuning knob with a knurled outer surface may be fixed to the end of the rod opposite the slider for manual adjustment of the rod, and a spring may be coiled about the rod for biasing the slider away from the knob.

The tremolo mechanism also preferably includes angled means for adjusting the tension on the strings in differing amounts when the detuning means is pivoted on the base. The base may be channel-shaped and may include a pair of opposing side walls, and the angled means preferably includes a pair of pivot arms mounted on an angle to the opposite side walls of the base. The pivot plate may include a pair of pins for pivotal attachment to the pivot arms. The detuning means also preferably includes means for biasing the pivot plate against the tension of the strings.

Alternative means are preferably included for compensating for the different stretch rates of the strings. In one such embodiment, the balls on the strings are disc shaped, and are threaded on the rounded surfaces thereof. The openings in the sliders are correspondingly threaded for receiving the balls in a screw-fit relation for individually adjusting the distance of each of the string ends from the pivot point of the detuning means. In a second embodiment, the openings are individually sized for receiving the balls at varying depths corresponding to the stretch rate of the individual strings. Spacers sized for insertion into the openings may also be provided for individually adjusting the position of the balls in the openings. In a further embodiment, each ball may include a threaded member extending therethrough for individual adjustment of the ball in the opening.

BRIEF DESCRIPTION OF THE DRAWINGS

The accompanying drawings which are incorporated in and constitute a part of this specification, illustrate at least one embodiment of the invention and, together with the description, serve to explain the principles of the invention.

Of the Drawings:

FIG. 12 is a cross-sectional view taken along the line 12—12 of FIG. 4;

FIG. 13 is a perspective view of one embodiment of the slider with the stretch compensating opening;

FIG. 14 is a perspective view of an alternative embodiment of the slider showing the use of a spacer;

FIG. 15 is a further perspective view of the slider with an externally threaded ball and a threaded opening; and FIG. 16 is an enlarged cross-sectional view taken along a line 16—16 of FIG. 15.

DESCRIPTION OF THE PREFERRED EMBODIMENT

Reference will now be made in detail to the present preferred embodiment of the invention, an example of which is illustrated in the accompanying drawings.

Figure 1:
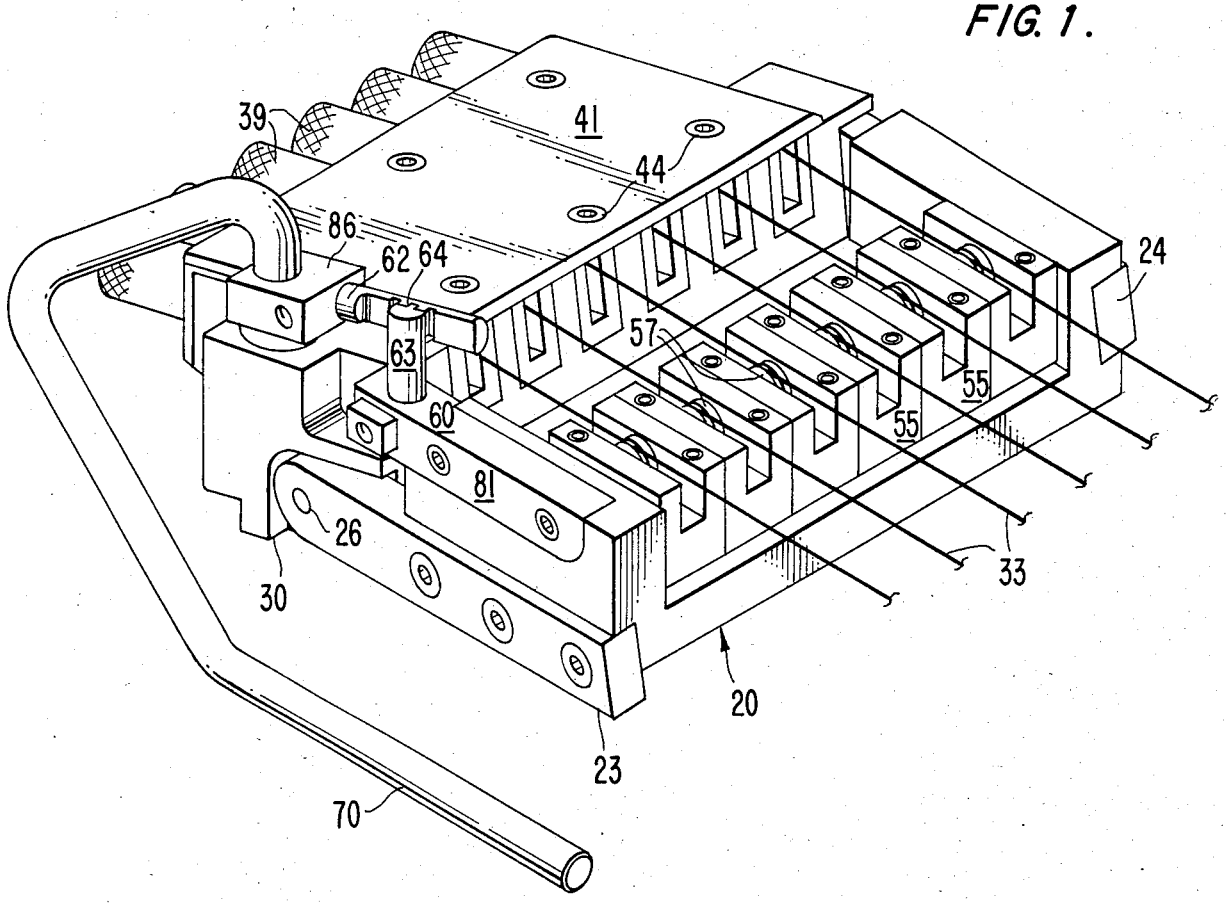
FIG. 1 is a perspective view of the tremolo mechanism of the invention as it would be mounted on a stringed instrument.
Figure 2:
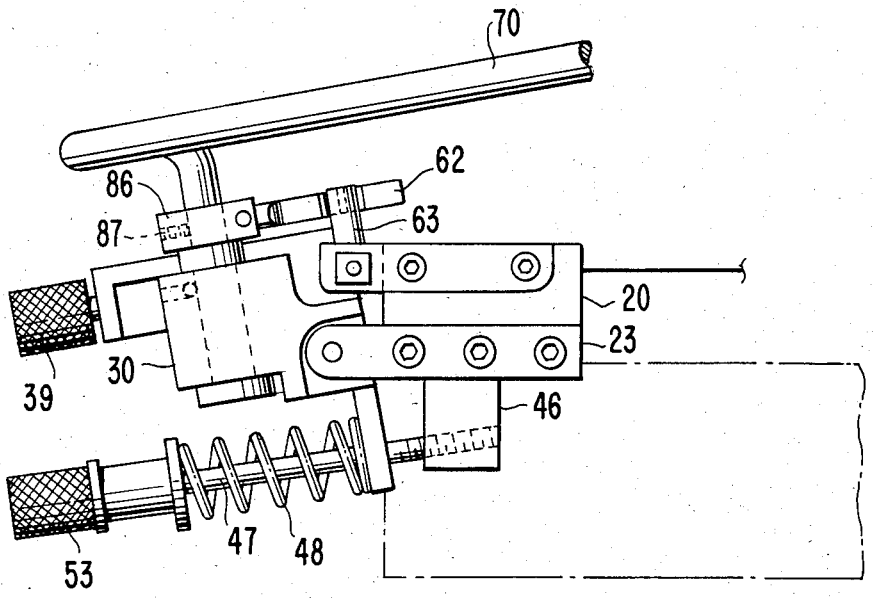
FIG. 2 is a side view of the tremolo mechanism showing the counteracting spring mechanism.
Figure 5:
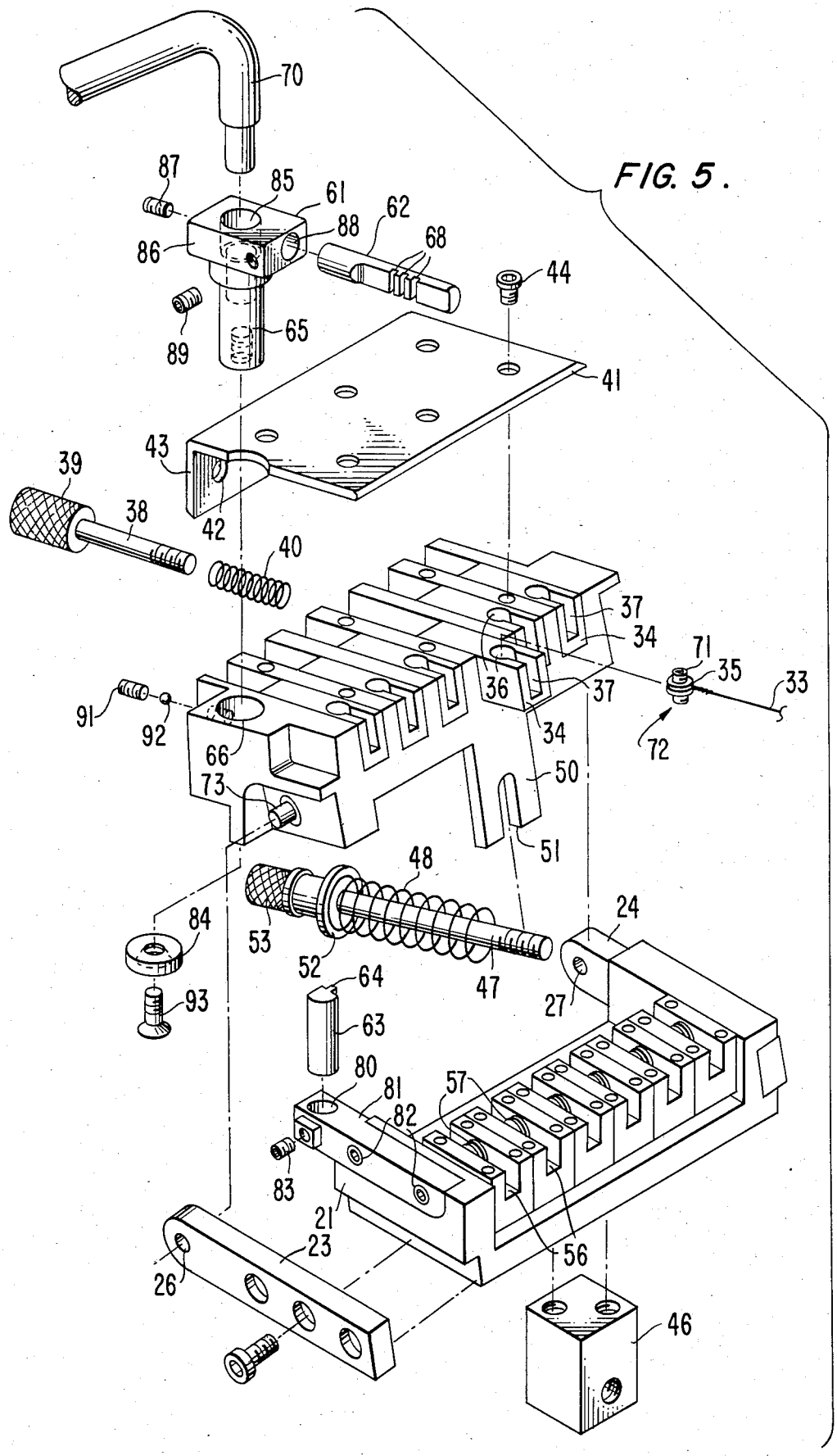
FIG. 5 is an exploded perspective view of the basic components of the tremolo mechanism.

Referring now to FIGS. 1 and 5, it may be seen that the tremolo mechanism provides a rapid and simple means for tuning a stringed musical instrument, and for detuning the strings while maintaining substantially the same pitch relationship between the strings.

In accordance with the invention, the tremolo mechanism is utilized on a stringed musical instrument including a body, a neck portion, a plurality of strings each anchored at one end to the neck portion and extending over at least a portion of the neck portion and the body. The mechanism comprises a base or support for attachment to the body; means pivotally mounted on the base for detuning the strings substantially evenly and for maintaining the strings in substantially the same pitch relative to each other when the detuning means is pivoted with respect to the base, including means for anchoring the other end of each string; and bridge means positioned between the detuning means and the neck. The detuning means preferably includes locking means for securing the detuning means against pivotal movement on the base.

Figure 6:
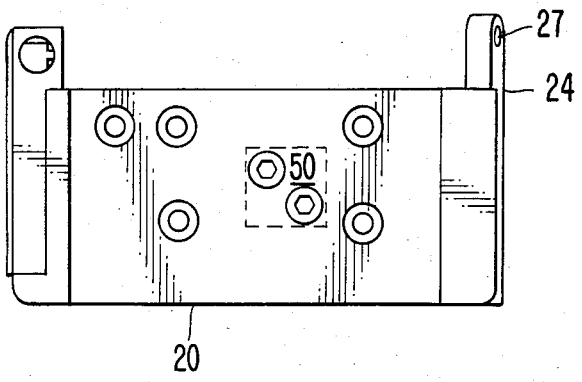
FIG. 6 is a bottom view of the base member.
Figure 7:
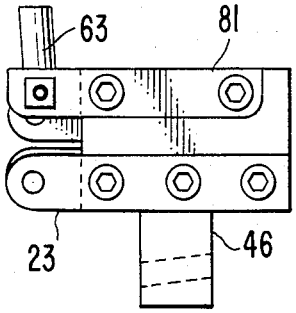
FIG. 7 is a side view of the base member showing the lock member.
Figure 8:
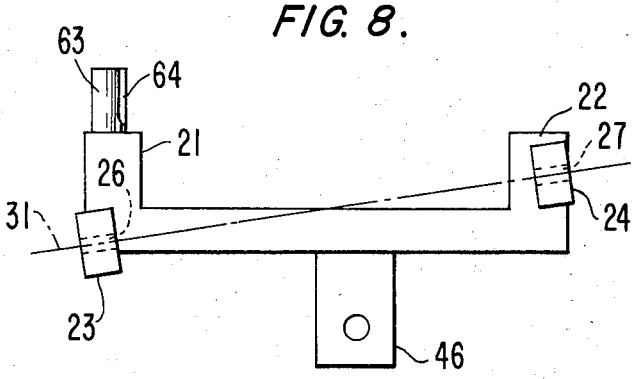
FIG. 8 is a front view of the base member showing the angled relationship of the pivot arms.
Figure 9:
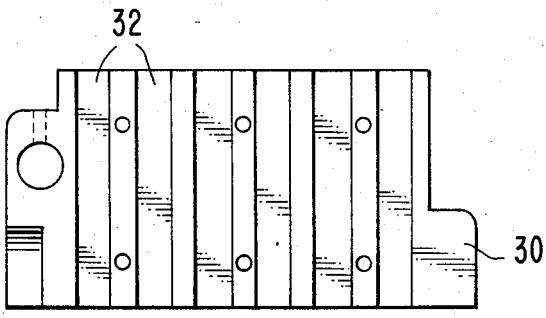
FIG. 9 is a top view of the pivot plate.
Figure 10:
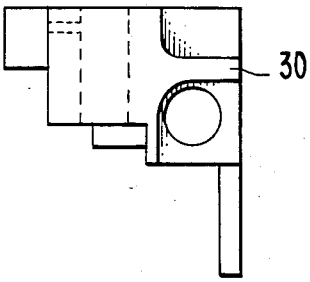
FIG. 10 is an end view of the pivot plate.
Figure 11:
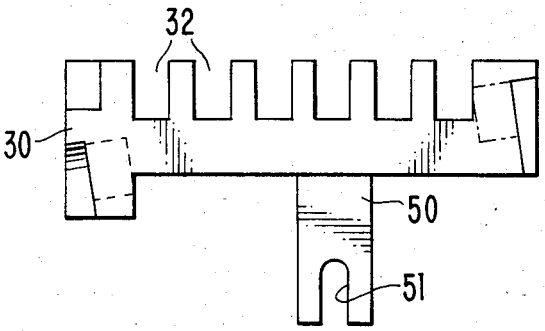
FIG. 11 is a front view of the pivot plate.

As embodied herein, the tremolo mechanism generally includes a base 20 for attachment to the body of a stringed musical instrument. As shown in FIGS. 6, 7 and 8 the base 20 is channel-shaped, and includes a pair of opposing side walls 21 and 22. A pair of pivot arms 23 and 24 are mounted on an angle to the opposite walls 21 and 22 of the base 20. The pivot arms 23 and 24 are angled with respect to the side walls 21 and 22, and with respect to the bottom surface 25 of the base 20. Each of the pivot arms 23 and 24 extends beyond the side walls 21 and 22, and a pair of aligned holes 26 and 27 extend through the pivot arms 23 and 24. In a preferred embodiment, the angle formed between the plane of the bottom surface 25 of the base 20 and a line passing through the holes 26 and 27 is about 8°. The base member 20 is preferably formed primarily of steel, and the pivot arms 23 and 24 are preferably also steel.

Alternatively, the base member may be a support of any type which will anchor the detuning means to the instrument and allow for pivotal movement thereon. For example, a pair of posts could be attached to the instrument, or the detuning means could be pivotally attached to a bracket or other anchoring device, or directly to the instrument.

As here embodied, the detuning means includes a pivot plate 30 mounted to the base 20 for pivotal movement about a pivot point or plane. The pivot point is generally depicted in FIG. 8 by the line 31. The plate 30 includes a plurality of channels 32, one of the channels corresponding to and aligned with each of the strings 33.

As here embodied, the means for anchoring the other end of the strings include a plurality of tuning sliders 34, one slider being slidably mounted in each of the channels 32. Preferably, each of the strings 33 includes a ball 35 on one end thereof, and each slider 34 includes an opening 36 for receiving one of the balls 35. As shown in FIG. 5, the openings 36 have an elongated portion 37 for allowing the string 33 to exit from the slider 34. Thus, the ball 35 can be dropped into the opening 36 quickly and efficiently. The strings preferably include a ball on each end, and the instrument may include structure for anchoring one end of each string to the neck, as disclosed in U.S. patent application Ser. No. 386,326, now abandoned in favor of continuation application Ser. No. 735,723, filed May 20, 1985 in the name of the same inventor, which disclosure is hereby incorporated herein by reference.

As here embodied, the detuning means also includes a plurality of threaded rods 38, one of the rods being threaded into each of the sliders 34 for adjusting the position of the slider in the channel 32 when the rod 38 is manually threaded into or out of the slide 34. Each of the rods 38 has a tuning knob 39 affixed to the end opposite the slider 34 for manual adjustment of the rod 38. As shown in FIG. 12, the surface of the knob may be knurled for facilitating manual adjustment. A spring 40 is coiled about each of the rods 38 for biasing the slider 34 away from the knob 39.

An L-shaped cover member 41 is mounted over the top of the channels 32, and blocks one end of each of the channels 32 for limiting the movement of each of the sliders 34 in the channels. A plurality of passages 42 pass through the rear portion 43 of the cover member 41, and one of the passages 42 is aligned with each of the channels 34. Each of the rods 38 passes through one of the passages 42. The cover member 41 may be attached to the pivot plate 30 by any suitable means such as set screws 44. The moving parts of the mechanism such as the pivot plate 30 are typically formed of aluminum, but other materials having suitable strength and low weight can be used.

As here embodied, the detuning means includes means for biasing the pivot plate against the tension of the strings. As here embodied, the pivot plate biasing means includes a tension block 46 mounted on the lower surface 25 of the base 20. An adjusting rod 47 is threaded into the tension block 46 and a counter spring 48 is coiled about the adjusting rod. The adjusting rod 47 interacts with the pivot plate 30 for counteracting the tension of the strings 33. A tongue 50 extends outwardly from the pivot plate 30, and a slot 51 in the tongue 50 fits over the adjusting rod 47. The adjusting rod 47 also includes a collar 52 for counteracting the force of the spring 48, and an enlarged roughened end 53 for facilitating manual adjustment of the rod 48. The tongue 51 interacts with the adjusting rod 47 and the tuning spring 48 for adjusting the position of the pivot plate 30 on the base 20 against the force of the strings 33.

As here embodied, the bridge means includes a plurality of individual bridge saddles 55 which are preferably mounted in the space between the side walls 21 and 22 of the base 20. The saddles 55 each include a groove 56 with a cylindrical insert 57 mounted therein. The bridge saddles 55 may be individually adjusted, and may be held firmly in place by set screws (not shown) in the side wall 22. The saddles 55 are preferably formed of brass.

As embodied herein, the locking means includes a lock member 60 fixed to the base 20, and a corresponding key member 61 pivotally attached to the pivot plate 30. The lock member 60 and the key member 61 interact for securing the pivot plate 30 against pivotal movement on the base 20. As shown in FIG. 5, the lock member 60 is mounted to the upper end of side wall 21, and includes a locking pin 63 having a projection 64 thereon. The pin 63 is generally semi-circular, and fits into a hole 80 in a lock bar 81. The lock bar 81 is attached to the side wall 21 by a pair of set screws 82. A set screw 83 frictionally contacts the pin 63 to hold it firmly in the hole 80. This arrangement also allows the pin 63 to be rapidly replaced when the projection 64 becomes worn.

Figure 3:
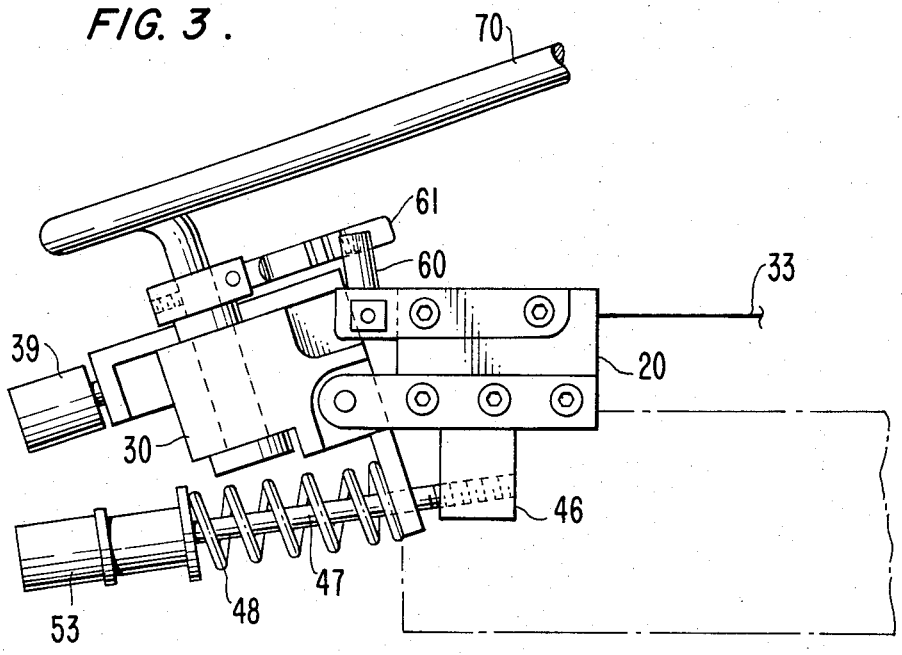
FIG. 3 is a view similar to FIG. 2 with the mechanism pivoted upward to increase the tension on the strings.
Figure 4:
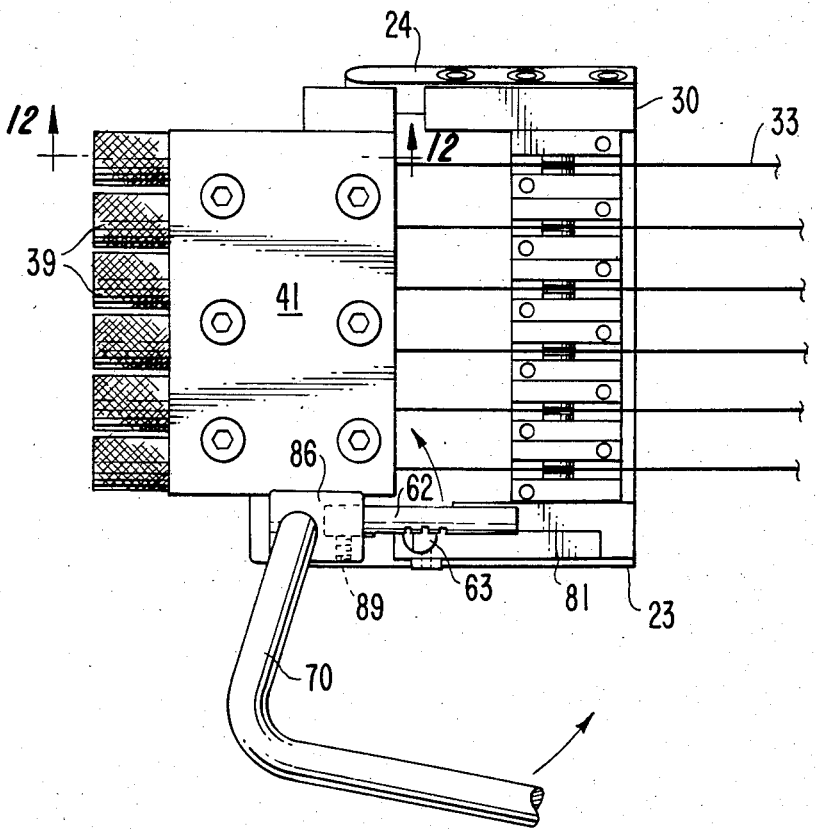
FIG. 4 is a top view of the tremolo mechanism of the invention showing the directions of movement of the handle and the key member.

A shaft 65 is formed on the key member 61, and the shaft 65 fits into a hole 66 in the pivot plate 30 to pivotally secure the key member 61 to the pivot plate 30. A screw 93 and washer 84 holds the shaft 65 in the hole 66, allowing adjustment of the frictional contact between the pivot plate 30 and the shaft 65. A set screw 91 and a ball 92 in the pivot plate 30 exert frictional pressure on the key member 61, allowing easy rotation thereof. An enlarged portion 86 is provided on the shaft 65 for receiving a key arm 62 therein. The key arm 62 extends generally perpendicular to the shaft 65 and is mounted in a hole 88 by a set screw 89. The key arm 62 includes a plurality of grooves 68 thereon sized to receive the projection 64 on the lock member 60. The grooves 68 are spaced apart to correspond with fixed musical intervals as further described below. As shown in FIGS. 3 and 4, rotation of the lock member 61 and the shaft 65 disengages the projection 64 from one of the grooves 68, and thereby unlocks the pivot plate 30 allowing it to pivot on the base 20.

A handle 70 may be attached to the shaft 65 for manual pivoting of the detuning means. As shown in FIG. 5, the handle 70 is inserted into an opening 85 in the enlarged portion 86 of the locking arm 61. A set screw 87 holds the handle 70 firmly in place, and allows for easy removal of the handle 70. The handle 70 also may be threaded into the shaft 65 so that it can be rotated freely with respect to the shaft 65.

In accordance with the invention, several alternative means are provided for compensating for the varying stretch rate of strings. As shown in FIG. 15, the balls 35 may be disc-shaped, and may be threaded on the rounded surfaces 69 thereof. The openings 36 in the sliders 34 may be corresponding threaded for receiving the balls 35 in a screw-fit relation for individual adjustment of the distance between the end of the string 33 from the pivot point of the pivot plane 30. As shown in FIG. 16, the threads 89 on the ball 35 may have a gap 90 therein defining a groove surrounding the ball 35 on the external rounded surface 69 thereof. One end of the string 33 surrounds the ball 35 in the gap 90 to allow for rotation of the ball 35 with respect to the string 33. A slot 91 on one end of the ball 35 is provided for receiving a screwdriver or other tool for manually rotating the ball 35.

Alternatively, as shown in FIG. 13, the openings 36 may be individually sized for receiving the balls 35 at varying depths corresponding to the stretch rate of the individual strings. Thus, the depth of the opening 36 may be made greater or lesser depending upon the desired distance of the string end from the pivot point of pivot plate 30. As shown in FIG. 14, spacers 71 may also be provided for insertion into the openings 34. The spacers 71 can be sized for insertion into the openings 34 thereby allowing individual adjustment of the balls 35 in the openings 34.

As shown in FIG. 5, the ball 35 may also include a threaded member 71 threaded through an opening 72 in the ball 35. Rotation of the threaded member 71 in the opening 72 allows for individual adjustment of the position of the ball 35 in the opening 36.

In operation, the tremolo mechanism provides a rapid and efficient means for tuning a stringed musical instrument, and for detuning the instrument substantially evenly, thereby maintaining the strings in substantially the same pitch relative to each other. The angled relationship of the pivot arms 23 and 24 with the pivot pins 73 (only one of which is shown in FIG. 5) on the pivot plate 30 allows the tension center to be closer to the lower strings and further away from the higher strings. Thus, the higher strings will move a greater distance when the pivot plate 30 is pivoted. By further adjusting the distance of the string ends from the pivot, the high and low strings can be made to move in any desired relationship.

However, due primarily to the fact that some strings are "plain" and others are "wound", the change in the rate of stretch from the higher to lower strings is not linear. As a result, it is desirable to be able to adjust the distance of each string from the pivot point on an individual basis. This is accomplished by orienting the openings 36 at approximately a 25° angle. Thus, the ball 35 is pulled down to the bottom of the opening 36 when tension is applied to the string 33. Individual string adjustment can then be achieved in any one of the ways described above.

For rapid tuning of the instrument, the locking mechanism is placed in the locked position by rotating the locking arm 61 until the projection 64 fits into a groove 68. When manual tension on the arm 70 against the bias of counter-spring 48 is released, the pivot plate 30 remains in the fixed locked position on the base 20. Each of the strings is then individually tuned to the desired pitch relationship. In the locked position, a change of the tension on one string will not change the tension of any other string, similar to a fixed bridge-type device. After the instrument is fully tuned and the locking mechanism is disconnected, by rotation of the locking arm 61 about the shaft 65, the tremolo mechanism will equalize the tension between the strings 33 and the counterspring 48. The important feature in this respect is the adjustable counterspring 48 which allows the musician to adjust the equilibrium point to match up exactly with the locking position utilizing a single spring adjustment knob 53. If, after unlocking the mechanism, the equilibrium point is low, the counterspring 48 is tightened until perfect tune is reached. A similar adjustment is made if the equilibrium point is high. The means for adjusting the equalized position of the tremolo mechanism to line up with a fixed center position is believed to be a significant advance in the art.

Increase of the frictional contact between the locking arm and the handle 70 allows the locking arm and the handle to move together in unison so that the mechanism can be locked by lateral movement of the handle 70. Thus, the unit can be locked and unlocked instantaneously with the same handle 70 which is used to activate the tremolo. As previously described, the member 61 includes a key arm 62 with a plurality of grooves 68 therein. The grooves are spaced to correspond with fixed musical pitch intervals. This allows a musician to easily lock the tremolo mechanism in any one of several alternative positions having predetermined pitch relationships. In addition, since the key arm 62 is easily removable and replaceable, separate key arms having differing spacing of the grooves may be used to rapidly change the interval relationships.

The invention also comprises a stringed musical instrument with the tremolo mechanism thereon, as well as the method of rapidly tuning a stringed musical instrument having a tremolo mechanism, as previously described.

As can be readily seen by those skilled in the art, various modifications and variations could be made in the tremolo mechanism of the invention without departing from the scope or spirit of the invention.

What is claimed is:

1. A tremolo mechanism for adjusting the string tension in a stringed musical instrument, the instrument including a body, a neck portion, a plurality of strings each anchored at one end to said neck portion and extending over at least a portion of said neck portion and said body, the mechanism comprising:

a support attached to said body;

means pivotally mounted on said support for detuning said strings substantially evenly and for maintaining said strings in substantially the same pitch relative to each other when said detuning means is pivoted with respect to said support, including means for anchoring the other end of each said string, and pivot means having a pivot axis which is oblique with relation to a plane generally defined by said strings for simultaneously moving said strings by varying distances relative to each other when said detuning means is pivoted on said support; and bridge means positioned between said detuning means and said neck.

2. The tremolo mechanism of claim 1 wherein said detuning means includes a pivot plate mounted to said support for pivotal movement about a pivot point, said plate including a plurality of channels, one said channel corresponding to and being aligned with each of said strings, and said means for anchoring the other end of each said string includes a plurality of tuning sliders, one said slider being slidably mounted in each said channel.

3. The tremolo mechanism of claim 2 wherein each said string includes a ball on one end thereof, and each said slider includes an opening for receiving one of said balls.

4. The tremolo mechanism of claim 3 wherein said balls are disc-shaped and are threaded on the rounded surfaces thereof, and said openings in said sliders are correspondingly threaded for receiving said balls in a screw-fit relation for individually adjusting the distance of each said string end from the pivot point of said tuning means.

5. The tremolo mechanism of claim 3 wherein said openings are individually sized for receiving said balls at varying depths corresponding to the stretch rate of the individual strings.

6. The tremolo mechanism of claim 3 wherein said detuning means also includes a plurality of threaded rods, one said rod being threaded into each of said sliders for adjusting the position of said slider in said channel when said rod is manually threaded in said slider.

7. The tremolo mechanism of claim 6 wherein each of said rods has a tuning knob fixed to the end opposite said slider for manual adjustment of said rods.

8. The tremolo mechanism of claim 7 wherein said knob has a knurled surface.

9. The tremolo device of claim 8 wherein each said rod includes means for biasing said slider away from said knob.

10. The tremolo mechanism of claim 9 wherein said biasing means includes a spring coiled about said rod.

11. The tremolo mechanisn of claim 10 wherein said detuning means also includes a cover member mounted over the top of said channels, said cover member blocking one end of each said channels for limiting the movement of each said slider in said channels, said cover including a plurality of passages, one said passages being aligned with each of said channels, and each said rod passing through one of said passages.

12. The tremolo mechanism of claim 3 also including spacers sized for insertion into said openings for individually adjusting the position of said balls in said openings.

13. The tremolo mechanism of claim 1 wherein said detuning means includes locking means for securing said detuning means against pivotal movement on said support.

14. The tremolo mechanism of claim 13 wherein said locking means includes a lock member fixed to said support and a corresponding key member pivotally attached to said detuning means, said lock member and said key member interacting for securing said detuning means against pivotal movement on said support.

15. The tremolo mechanism of claim 14 also including a handle for manual pivoting of said detuning means.

16. The tremolo mechanism of claim 15 wherein said detuning means includes a pivot plate mounted to said support for pivotal movement about a pivot point, said key member and said handle being both mounted to a single shaft on said pivot plate.

17. A tremolo mechanism for adjusting the string tension in a stringed musical instrument, the instrument including a body, a neck portion, a plurality of strings each anchored at one end to said neck portion and extending over at least a portion of said neck portion and said body, the mechanism comprising:

a support attached to said body;

means pivotally mounted on said support for detuning said strings substantially evenly and for maintaining said strings in substantially the same pitch relative to each other when said detuning means is pivoted with respect to said support, including means for anchoring the other end of each said string; and bridge means positioned between said detuning means and said neck, said support being channel-shaped and including a pair of opposite side walls, and said detuning means including a pair of pivot arms mounted on an angle to the opposite side walls of said support, and a pair of pins for pivotal attachment to said pivot arms.

18. The tremolo mechanism of claim 17 wherein said detuning means includes a pivot plate mounted to said support for pivotal movement on said pivot arms, and means for biasing said pivot plate against the tension of said strings.

19. The tremolo mechanism of claim 18 wherein said pivot plate biasing means includes a tension block mounted on the lower surface of said support, an adjusting rod threaded into said tension block, and a tuning spring coiled about said adjusting rod, said adjusting rod interacting with said pivot plate for counteracting the tension of said strings.

20. The tremolo mechanism of claim 19 wherein said pivot plate includes a tongue extending therefrom, said tongue interacting with said adjusting rod and said tuning spring for adjusting the position of said pivot plate on said support against the force of said strings.

21. The tremolo mechanism of claim 20 wherein said bridge means is mounted in the space between said side walls of said support.

22. A string for a stringed musical instrument comprising a string member, a threaded member corresponding to said string, and a ball mounted on one end of said string member, said ball including a threaded opening for receiving the threaded member.

23. A tremolo mechanism for adjusting the string tension in a stringed musical instrument, the instrument including a body, a neck portion, a plurality of strings each anchored at one end to said neck portion and extending over at least a portion of said neck portion and said body, the mechanism comprising:

a support attached to said body;

means pivotally mounted on said support for detuning said strings substantially evenly and for maintaining said strings in substantially the same pitch relative to each other when said detuning means is pivoted with respect to said support, said pivotally mounted means including means for anchoring the other end of each said string, said means for anchoring the other end of each said string including a plurality of tuning sliders, each said string including a ball on one end thereof, and each said slider including an opening for receiving one of said balls;

bridge means positioned between said detuning means and said neck; and a threaded member corresponding to each said string, each said ball including a threaded opening therethrough for receiving the threaded member for individual adjustment of the position of each said ball in said openings.

24. A tremolo mechanism for a stringed musical instrument, the instrument including a body, a neck, and a plurality of strings attached at one end to said neck portion and extending over at least a portion of said neck and said body, the mechanism comprising:

means for anchoring the other end of each said string;

means pivotally mounted to said instrument for detuning said strings when said detuning means is pivoted with respect to said instrument including pivot means having a pivot axis which is oblique with relation to a plane generally defined by said strings for simultaneously moving said strings by varying distances relative to each other when said detuning means is pivoted on said support; and means for counteracting the tension of said strings, said counteracting means including a single threaded rod having a knurled knob on one end thereof for manual adjustment of said counteracting means.

25. The tremolo mechanism of claim 24 wherein said counteracting means also includes a tuning spring coiled about said rod, and a collar on said rod for resisting the force of said spring.

26. A tremolo mechanism for a stringed musical instrument, the instrument including a body, a neck portion, and a plurality of strings attached at one end to said neck portion and extending over at least a portion of said neck portion and said body, the mechanism comprising:

means for anchoring the other end of each said string;

means pivotally mounted on said instrument for detuning said strings when said detuning means is pivoted with respect to said instrument including pivot means having a pivot axis which is oblique with relation to a plane generally defined by said strings for simultaneously moving said strings by varying distances relative to each other when said detuning means is pivoted on said instrument; and locking means for securing said detuning means against pivotal movement on said instrument.

27. The tremolo mechanism of claim 26 also including a support member attached to the body of said instrument, said detuning means being pivotally mounted on said support, and said locking means includes a lock member fixed to said support and a corresponding key member pivotally attached to said detuning means, said lock member and said key member interacting for securing said detuning means against pivotal movement on said support.

28. A tremolo mechanism for a stringed musical instrument, the instrument including a body, a neck portion, and a plurality of strings attached at one end to said neck portion and extending over at least a portion of said neck portion and said body, the mechanism comprising:

means for anchoring the other end of each said string;

means pivotally mounted on said instrument for detuning said strings when said detuning means is pivoted with respect to said instrument; and locking means for securing said detuning means against pivotal movement on said instrument, said locking means including means for locking said mechanism in multiple locking positions corresponding to fixed pitch intervals of said strings.

29. The tremolo mechanism of claim 28 also including means for varying said fixed intervals.

30. The tremolo mechanism of claim 29 also including a support attached to the body of said instrument, said detuning means being pivotally mounted on said support, said locking means including a lock member fixed to said support and a corresponding key member pivotally attached to said detuning means, said lock member and said key member interacting for securing said detuning means against pivotal movement on said support, and said means for locking the mechanism in multiple locking positions including a plurality of grooves in said key member, and a projection on said lock member sized to fit in each of said grooves for securing said detuning means against pivotal movement.

31. The tremolo mechanism of claim 30 wherein said means for varying said fixed intervals includes a second key member, said second key member including a plurality of second grooves therein, said second grooves being spaced apart by distances different from the distances between said grooves in said key member.

32. The tremolo mechanism of claim 31 wherein said locking arm and said key member are each secured by a single set screw for rapid replacement of said locking arm and said key member.

33. A method for rapidly tuning a stringed musical instrument having a tremolo mechanism thereon, comprising the steps of:

locking the tremolo mechanism in a fixed position on said instrument;

anchoring one end of the strings of the instrument to the neck thereof;

anchoring the other end of the strings of said instrument to said locked tremolo mechanism;

individually tuning each string of the instrument to a desired pitch;

unlocking the tremolo mechanism for pivotal movement of a portion thereof with respect to said instrument about a pivot axis which is oblique with relation to a plane generally defined by the strings for simultaneously moving the strings by varying distances relative to each other;

adjusting the position of said portion against a bias for simultaneously retuning all said strings to said desired individual pitches.

34. A stringed musical instrument comprising:

a body;

a neck portion;

a plurality of strings each anchored at one end to said neck portion and extending over at least a portion of said neck portion and said body;

means pivotally mounted on said instrument for detuning said strings substantially evenly and for maintaining said strings in substantially the same pitch relative to each other when said detuning means is pivoted with respect to said instrument, including means for anchoring the other end of each said string, and pivot means having a pivot axis which is oblique with relation to a plane generally defined by said strings for simultaneously moving said strings by varying distances relative to each other when said detuning means is pivoted on said instrument; and bridge means positioned between said detuning means and said neck.

35. The stringed musical instrument of claim 34 wherein said instrument includes tuning means on said neck for adjusting the tension on said strings.

36. The stringed musical instrument of claim 34 wherein said means for anchoring the other end of each said string includes tuning means for adjusting the tension on said strings.

* * * * *